United States Patent [19]

Sapkus et al.

[11] 4,217,725

[45] Aug. 19, 1980

[54] COMBINATION DOLL AND ACCESSORY ARTICLES

[75] Inventors: Jurgis Sapkus, Manhattan Beach; J. Stephen Lewis, Pacific Palisades, both of Calif.

[73] Assignee: Mattel, Inc., Hawthorne, Calif.

[21] Appl. No.: 952,014

[22] Filed: Oct. 16, 1978

[51] Int. Cl.[3] ..... A63H 29/16; A63J 3/00; A63H 11/00; A63H 13/16

[52] U.S. Cl. ..... 46/44; 272/8 N; 46/135 R; 46/145; 46/153

[58] Field of Search ..... 46/44, 145, 135 R, 146, 46/153; 272/27 B, 8 R, 8 N, 27 R, 27 N

[56] References Cited

U.S. PATENT DOCUMENTS

| | | | |
|---|---|---|---|
| 741,360 | 10/1903 | Moseley | 46/44 |
| 2,432,337 | 12/1947 | Petrie | 272/8 R |
| 2,593,188 | 4/1952 | Rikelman | 46/44 |
| 2,619,771 | 12/1952 | Jones | 46/154 |
| 3,309,082 | 3/1967 | Hindman | 272/27 N |
| 3,353,823 | 11/1967 | Sabel | 272/8 N |
| 3,605,326 | 9/1971 | Baginski et al. | 272/8 N |
| 3,757,463 | 9/1973 | Breslow et al. | 46/118 |
| 3,882,631 | 5/1975 | Goldfarb et al. | 46/44 |
| 4,067,138 | 1/1978 | Cederholm et al. | 46/44 |

*Primary Examiner*—Louis G. Mancene
*Assistant Examiner*—Michael J. Foycik
*Attorney, Agent, or Firm*—John C. Mesaros; Ronald M. Goldman; Max E. Shirk

[57] ABSTRACT

A doll having an air-contained compressible body portion the interior thereof communicating with an aperture in the palm of the hand of the doll. An accessory article such as a hat has a tubular portion insertable within the aperture with a valve selector manually operable to one of three positions for pneumatically actuating one of three conduits within the hat for elevating a movable object above the rim of the hat in response to compression of the body portion.

14 Claims, 11 Drawing Figures

COMBINATION DOLL AND ACCESSORY ARTICLES

BACKGROUND OF THE INVENTION:

The background of the invention will be discussed in two parts:

1. Field of the Invention

This invention relates to dolls and more particularly to the combination of a doll and accessory articles for use with the doll.

2. Description of the Prior Art

Pneumatically operated toys and the like are very popular with children. U.S. Pat. No. 741,360 discloses a toy having a receptacle provided with an air opening through which air may be forced into or withdrawn from for inflating or collapsing a tubular figure adapted to normally be contained within the hollow interior of the receptacle.

Other toys which utilize bellows for moving various components of a toy figure such as arms and eyes are shown respectively in U.S. Pat. Nos. 3,757,463 and 3,883,631.

With the advent of vinyl foam molding processes, dolls are presently being produced wherein the torso and appendages are constructed in one piece with a flexible skin-like outer covering. Such dolls have achieved tremendous popularity.

Accordingly it is a object of the present invention to provide a new and improved combination doll and accessory article.

It is another object of the present invention to provide a doll and article combination to effect the illusion of the doll performing magic tricks.

It is a further object of the present invention to provide a pneumatically actuated accessory article connectable to a doll for operation thereof by compression of the body portion of the doll.

SUMMARY OF THE INVENTION:

The foregoing and other objects of the invention are accomplished by providing a doll having an air-contained compressible body portion with a cavity formed on the interior thereof with a flexible covering on the doll torso at least in proximity to the cavity, the interior of the cavity being in fluid communication with an aperture in the palm of the hand of the doll, the aperture being configured for receiving the tubular portion of an accessory article which is pneumatically operated. The article may be in the form of a top hat having a valve selector within the closed end of the crown for selectively passing the air through the tubular portion into one of a plurality of conduits, each conduit being configured for receiving an object movable above the brim of the hat in response to movement of the air with the hat held in an inverted position in the palm of the hand. The movable objects may include a simulated bird, a spring biased retractable coiled flexible member or confetti. A second article is configured in the form of a tube having a slidable piston therein coupled to flexible strands of material to simulate a bouquet.

Other objects, features, and advantages of the invention will become apparent from a reading of the specification when taken in conjunction with the drawings in which like reference numerals refer to like elements in the several views.

Figure 1:
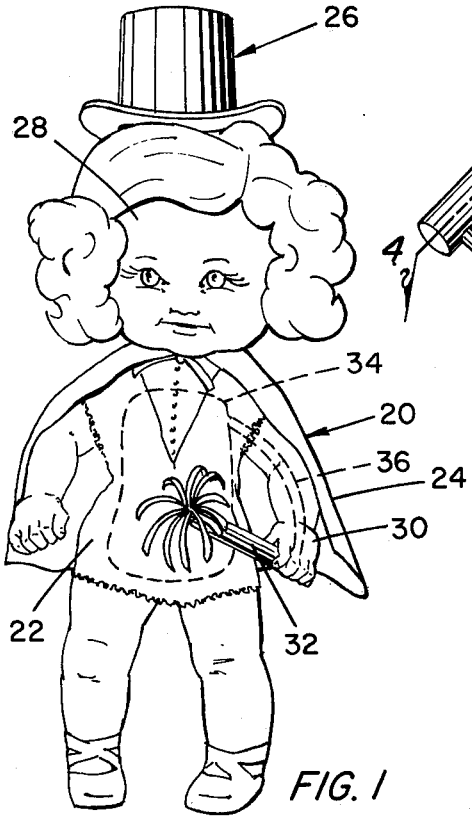
FIG. 1 is a front view of the doll holding an accessory article.

DESCRIPTION OF THE PREFERRED EMBODIMENT:

Referring now to the drawings and particularly to FIG. 1, there is shown a doll generally designated 20 having a torso 22 which may be formed for example from a flexible vinyl foam material in one piece with the arms and legs thereof integral therewith. The doll 20 is dressed in the attire of a magician with a cape 24 and a top hat generally designated 26 resting on the head 28 thereof. The left hand 30 of the doll is configured for grasping an accessory article 32 which may be for example in the form of a simulated bouquet.

The torso 22 may have the body portion thereof formed as a hollow air-contained compressible cavity 34 to form a bellows means, or alternatively may have a separate bellows inserted therein, the bellows means or cavity 34 being in fluid communication with a tubular extension 36 in the arm of the doll 20 with an aperture 38 in the palm of hand 30. Depression of the bellows 34 passes air out through the aperture 38 while release of the bellows 34 draws air in through aperture 38.

Figure 2:
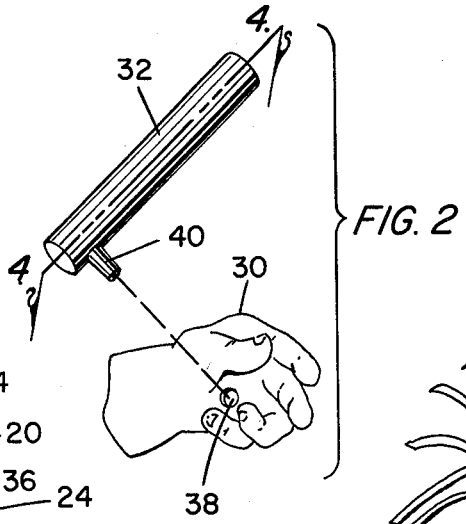
FIG. 2 is a partial exploded perspective view illustrating the hand of the doll of FIG. 1 and an accessory article.
Figure 3:
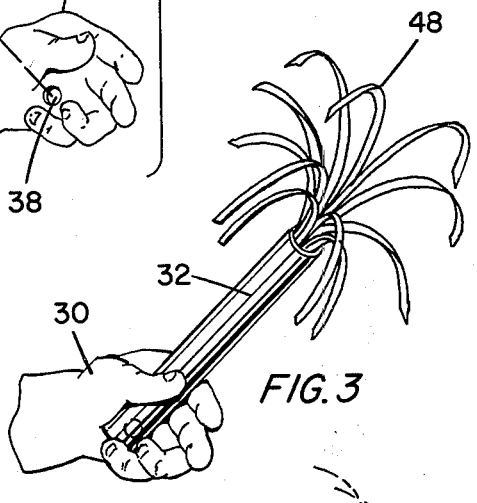
FIG. 3 is a view similar to FIG. 2 with the accessory article retained in the hand of the doll.
Figure 4:
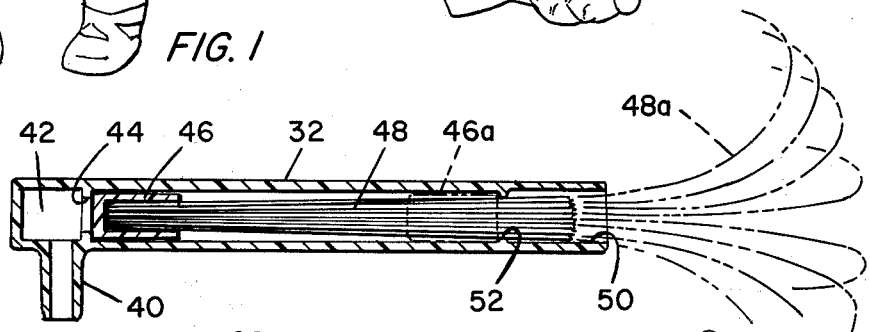
FIG. 4 is a cross sectional view of the accessory article shown in FIGS. 1–3.
Figure 6:
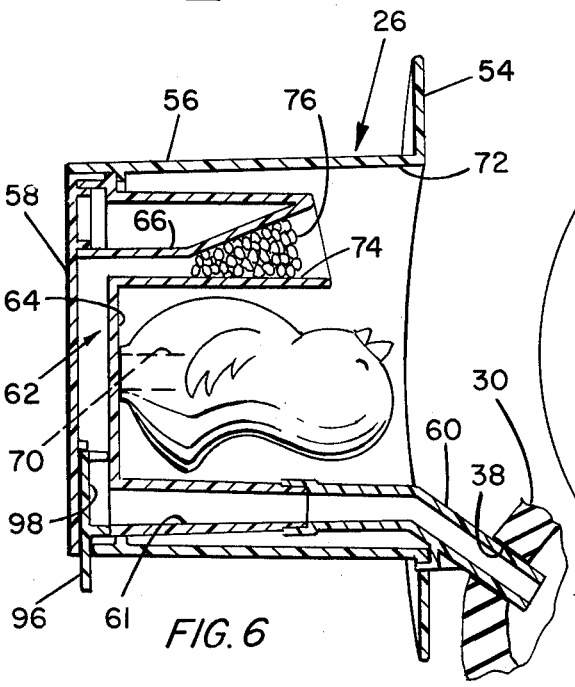
FIG. 6 is a cross sectional view of the accessory article of FIG. 5 as viewed generally along Line 6—6 thereof.
Figure 5:
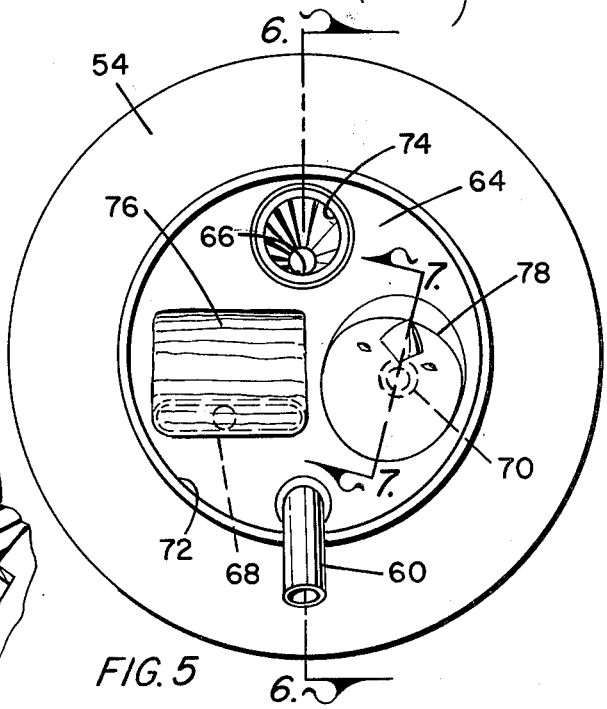
FIG. 5 is a top plan view of a second accessory article in the form of a top hat.

As better illustrated in FIGS. 2–4, the aperture 38 is configured for receiving therein the tubular portion 40 of the accessory article 32 so that air passing out of aperture 38 passes into the interior of the accessory article 32. As seen in FIG. 4, the tubular portion 40 of accessory article 32 provides an air passage conduit to an inner chamber 42 of the accessory article 32 which is generally circular in cross section and having an inwardly extending shoulder portion 44 at one end of chamber 42 with the other end thereof being closed. A piston 46 having an outside diameter slightly smaller than the inside diameter of the tubular portion of the article 32 is mounted therein for axial movement in response to air passing into chamber 42 through tubular portion 40. The piston 46 is generally cup-shaped with the cupped end thereof receiving the first end of a plurality of flexible ribbon members, the one end being adhesively secured within the cup-shaped piston 46. With passage of air into chamber 42, the piston 46 is displaced axially to the dotted line position designated 46*a* with the flexible ribbons flaring outwardly to the dotted line position designated 48*a* to simulate a bouquet, it being understood that the orientation of the accessory article 32 will be generally upwardly as depicted in FIGS. 1 and 3. Adjacent the open end 50 of the article 32, an inwardly extending stop shoulder portion 52 is provided for limiting the upward movement of piston 46. The piston 46 then returns to its original position under the force of gravity or alternatively under the force of the air returning into the bellows 34.

A second accessory article is depicted in FIGS. 5, 6, 9, and 11, this article being in the form of the top hat 26 which includes a brim portion 54 and a crown portion 56 having a closed end 58. The hat 26 is provided with a tubular member 60 extending above the brim 54 thereof, the tubular member 60 being configured for insertion through aperture 38 of the hand 30 (see FIG. 6). The tubular member 60 is formed integrally with or secured to the brim 54 of the hat 26, the member 60 being of a relatively rigid construction for insertion within the aperture 38. The tubular member 60 is in fluid communication with a plenum chamber generally designated 62 formed between the bottom 58 of crown 56 and a partition 64 in spaced generally parallel relation therewith. This plenum 62 in turn communicates with one of three openings or conduits shown in FIG. 5 and designated 66, 68 (an elongated slot shown in dotted lines), and 70 (shown in dotted lines).

With reference to the accompanying description, it is to be understood that notwithstanding the orientation of the hat 26 in the figures, the hat 26 will have the tubular member 60 inserted into the palm 32 with the hat 26 in an inverted position, that is with the closed end 58 of crown 56 disposed downwardly relative to the brim 54. Likewise, references to movable objects extending above the brim are intended to be illustrative of the operation of the accessory article or hat 26 and not intended to be limiting. In any event, each of the conduits 66, 68, and 70 is intended to pneumatically actuate an object or member which is movable from a position substantially within the interior compartment 72 to a position above the brim 54 of the hat 26. For example, the conduit 66 is in fluid communication with a generally upwardly extending funnel-shaped receptacle 74 configured for receiving articles therein such as confetti 76 which rises above the brim 54 of the hat in response to air passing through conduit 66. The conduit 68 may be in the form of an elongated slot or may commence with a smaller diameter opening converging upwardly to form slot 68 which in turn actuates a spring biased retractable coiled flexible member 76 in the form of the conventional party favor. The conduit 70 may actuate a figure in the form of a rabbit or bird 78 which is axially slidable relative to conduit 70 along a line generally perpendicular to the plane of partition 64.

Figure 7:
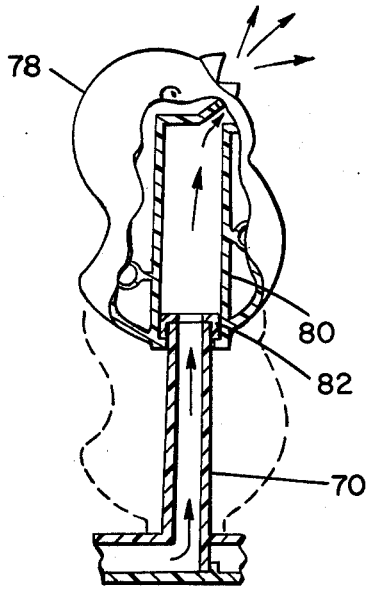
FIG. 7 is a partially broken away partially cross sectional view of one of the movable components within the hat of FIG. 5 as viewed generally along Line 7—7 thereof.
Figure 8:
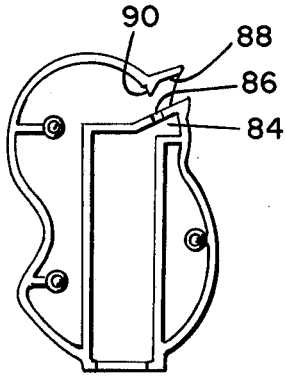
FIG. 8 is an enlarged view of a shell half of the movable article of FIG. 7 illustrating the air release and whistling portion thereof.
Figure 9:
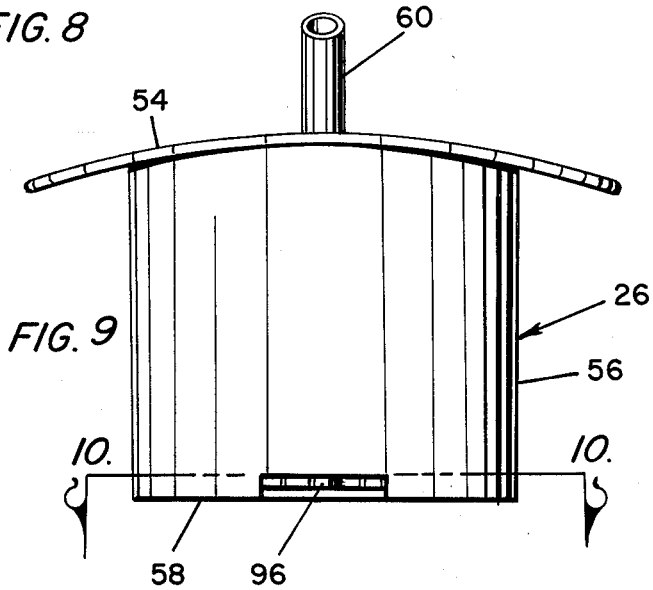
FIG. 9 is a front elevational view of the accessory article of FIG. 5.

The operation of the bird 78 is best illustrated in FIGS. 7 and 8 wherein the conduit 70 is an elongated tubular member having movably mounted thereon a bird 78 which is provided with an interior tubular portion 80 slidably engaging the outer diameter of conduit 70 with sealing means 82 interposed between the outer diameter of conduit 70 and the inner diameter of tubular portion 80 to maximize the movement in response to transfer of air through conduit 70. Movement of the air in the direction indicated by the arrow elevates the bird 78 from the dotted line position to the solid line position indicated in FIG. 7. As also illustrated in FIG. 8, the upper portion of tubular portion 80 is provided with an angularly offset chamber 84 in proximity to the beak of the bird with a narrow orifice 86 permitting the escape of air through the opening 88 of the beak of the bird 78. Disposed generally opposite to the orifice 86 is a sharp edge 90 which, as air escapes through orifice 86, generates a whistling sound upon movement of the bird 78 to the elevated position shown in FIG. 7.

Figure 11:
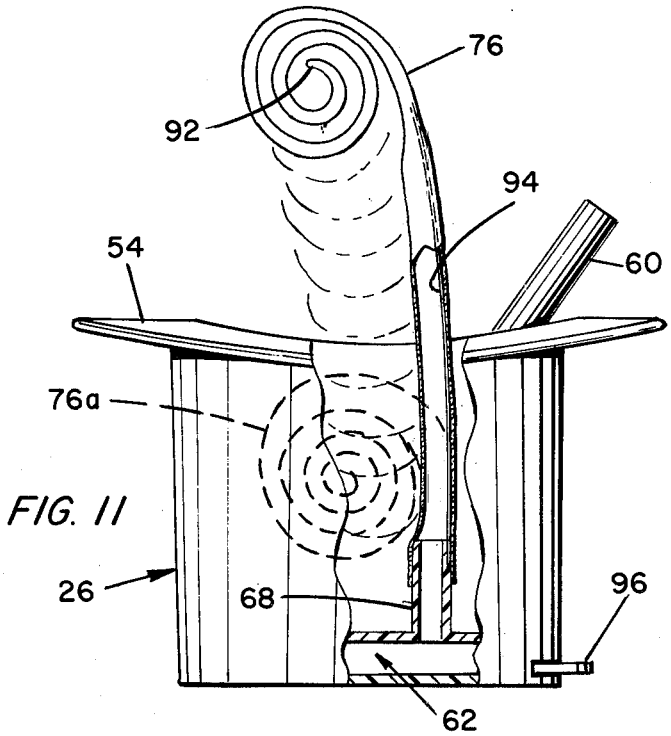
FIG. 11 is a side elevational view of the accessory article of FIG. 5, partially broken away and partially in cross section depicting a second movable component thereof.

By reference to FIG. 11, the coiled flexible member 76 may be formed from a flexible plastic material or from paper configured in the form of a tube with the end 92 thereof sealed. To maintain the coil, a flexible wire or spring member 94 is contained within this tubular envelope to normally bias the member 76 in a coiled position within the interior compartment 72 of the hat 26. The open end of the envelope of flexible member 76 is positioned about the periphery of conduit 68 for retention within hat 26. As air passes in the direction indicated by the arrow in FIG. 11, the member 76 will expand to the position shown and upon release, the member 76 will retract in a coiled position under force of the spring 94 to the position shown in dotted lines designated 76*a*. The member 76, being in the form of an elongated flat surface when extended, may have suitably imprinted thereon illustrations such as that of a rabbit or the like to further enhance the illusion.

Figure 10:
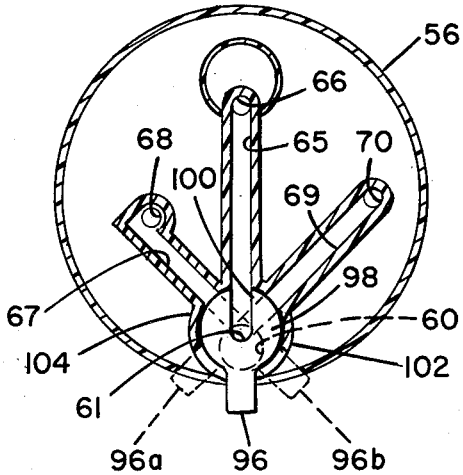
FIG. 10 is a cross sectional view of the valve selector mechanism of the article of FIG. 9 as viewed generally along Line 10—10 thereof.

To permit the selective operation of one of the movable components within the interior compartment 72 of the hat 26, a manually operable lever 96 extends outwardly adjacent the closed end 58 of the crown 56 of the hat 26, the lever 96 being manually operable to one of three positions by the child while demonstrating the doll 20. As better illustrated in FIG. 10, the lever 96 is pivotally mounted within the plenum portion 62 to one of three positions designated 96, 96*a*, and 96*b*. The plenum chamber 62 is essentially a three-pronged passageway (see FIG. 10) with passageways 65, 67, and 69 respectively communicating with the apertures or conduits 66, 68, and 70. Selection of the appropriate passageway for passage of air is made by means of a disc-shaped valve member 98 having as an integral part thereof the lever 96. The disc-shaped valve member 98 has an open-ended slot 100 formed therein, the slot 100 as depicted in FIG. 10 being in communication with the passageway 65 to conduit 66 as well as the inlet passageway 61 communicating with the tubular member 60 of the hat 26. The disc-shaped valve 98 is rotatably received within the closed end 58 of crown 56 by means of integrally formed arcuate segments 102 and 104 which define a close fitting peripheral shoulder for enabling pivotable or rotatable movement of the valve member 98 by manipulation of the lever 96. For example, when the lever is in the dotted line position designated 96*a* the slot 100 is in alignment with the passageway 69 to pass air through the conduit 70 for axially displacing the bird 78. When the lever 96 is displaced to the dotted line position designated 96*b*, likewise the slot 100 will be in alignment with the passageway 67 for passage of air through conduit 68 to actuate the coiled flexible member 76. In the solid line position shown in FIG. 10, the fluid communication is with the funnel shaped receptacle 74 communicating with conduit 66. By selective manipulation of the lever 96, upon depression of the bellows 34 within the torso of doll 20 and with the hat 26 coupled to the hand 30 thereof, the child may select a particular object for movement above the brim of the hat.

Although there has been shown and described a preferred embodiment, it is to be understood that various other adaptations and modifications may be made within the spirit and scope of the invention.

What is claimed is:

1. In a toy, the combination comprising:

a doll including a doll covering and having a torso with bellows means therein with at least a portion of the doll covering in proximity to said bellows means being flexible;

an arm member on said doll, said arm member having an aperture in the hand portion thereof and air passage means interconnecting said bellows means and said aperture; and a detachable article configured for engagement with the hand of said doll and having means in fluid communication with said aperture, said article having means movable in response to compression of said bellows means.

2. The combination according to claim 1 wherein said doll has a unitary flexible torso and said bellows means is formed by providing an air-contained compressible cavity therein.

3. The combination according to claim 2 wherein said article includes a tubular portion insertable within said aperture.

4. The combination according to claim 3 wherein said arm member is integrally formed with said torso.

5. The combination according to claim 4 wherein said article has an elongate cylindrical configuration with a closed end and an open end and a piston member is axially displaceable within said cylindrical portion under the force of the air.

6. The combination according to claim 5 wherein said article further includes flexible ribbon members having one end thereof secured to said piston member with the other ends thereof extending toward said open end and being normally contained within said cylindrical portion, movement of said piston toward said open end extending said flexible ribbon members outwardly of said open end to simulate a bouquet.

7. The combination according to claim 3 wherein said article includes a simulated hat member and said tubular portion is a part of said hat member.

8. The combination according to claim 7 wherein said hat member includes a plurality of articles movably mounted therein, said hat member including means manually operable for selection of one of said articles for movement.

9. The combination according to claim 8 wherein said manually operable means includes a valve member.

10. The combination according to claim 9 wherein said hat member includes conduit means in communication with each of said movable members and said valve member selectively passes air from said tubular portion through one of said conduit means.

11. The combination according to claim 10 wherein said hat includes a brim portion and at least one of said movable articles is movable above said brim portion.

12. The combination according to claim 11 wherein said conduit means includes a tubular member fixedly mounted within said hat member and an animal-like figure is provided with a cylindrical portion on the interior thereof for axial movement relative to said tubular member in response to air passing therethrough.

13. The combination according to claim 11 wherein one of said conduit means communicates with the interior of an elongate closed end sleeve member having a spring member therein for normally coiling said sleeve member which is uncoiled in response to air passing therein.

14. The combination according to claim 11 wherein one of said conduit means communicates with a generally funnel-shaped receptacle configured for receiving loose material therein, the material being ejected in response to the passage of air through said conduit means.

* * * * *